United States Patent [19]

Noble

[11] 4,272,915

[45] Jun. 16, 1981

[54] AUDIO-VISUAL AMUSEMENT DEVICE

[75] Inventor: Sidney Noble, Taipei, Taiwan

[73] Assignee: Mego Corp., New York, N.Y.

[21] Appl. No.: 79,661

[22] Filed: Sep. 28, 1979

[51] Int. Cl.[3] ..... A63H 33/26; A63H 11/00

[52] U.S. Cl. ..... 46/232; 46/265

[58] Field of Search ..... 46/232, 14, 253, 210, 46/264, 265, 266; 40/906, 414, 415, 419, 455, 457

[56] References Cited

U.S. PATENT DOCUMENTS

| | | | |
|---|---|---|---|
| 1,920,027 | 7/1933 | Wilhelm | 46/232 |
| 3,163,960 | 1/1965 | Iwaya | 46/253 |
| 3,164,924 | 1/1965 | Iwaya | 40/455 |
| 3,702,515 | 11/1972 | Beasley et al. | 46/232 |
| 3,858,872 | 1/1975 | Summerfield | 46/253 |
| 4,107,462 | 8/1978 | Asija | 40/457 |
| 4,169,335 | 10/1979 | Betancourt | 46/232 |
| 4,186,519 | 2/1980 | Repka | 46/232 |

*Primary Examiner*—Gene Mancene
*Assistant Examiner*—Michael J. Foycik, Jr.
*Attorney, Agent, or Firm*—Bertram Frank

[57] ABSTRACT

An audio-visual amusement device is provided wherein one or more movable animated figures are associated with a housing structure containing an audio-amplifier, and from which extends an elongated cable terminating in a microphone and dual control head, one control establishing electrical circuit between the microphone and amplifier, and the other control activating an electrical drive mechanism which imparts motion to the animated figures. The housing structure includes a main housing with a horizontal partition to which a drive mechanism sub-assemblage and electrical circuit components can be mounted and tested before a top closure sub-assemblage carrying the animated figures, and finally a bottom closure providing battery storage, are respectively attached to complete the overall assemblage. In a disclosed adaptation the motion of a first figure simulates hand clapping, while the motion of a second figure, if present, simulates excited jumping. A part of the drive mechanism is utilized in generating a sound synchronized with, and providing audio accompaniment for the hand clapping. A part of the drive mechanism includes an arrangement for imparting motion to the second animated figure, if present.

9 Claims, 7 Drawing Figures

FIG. 4
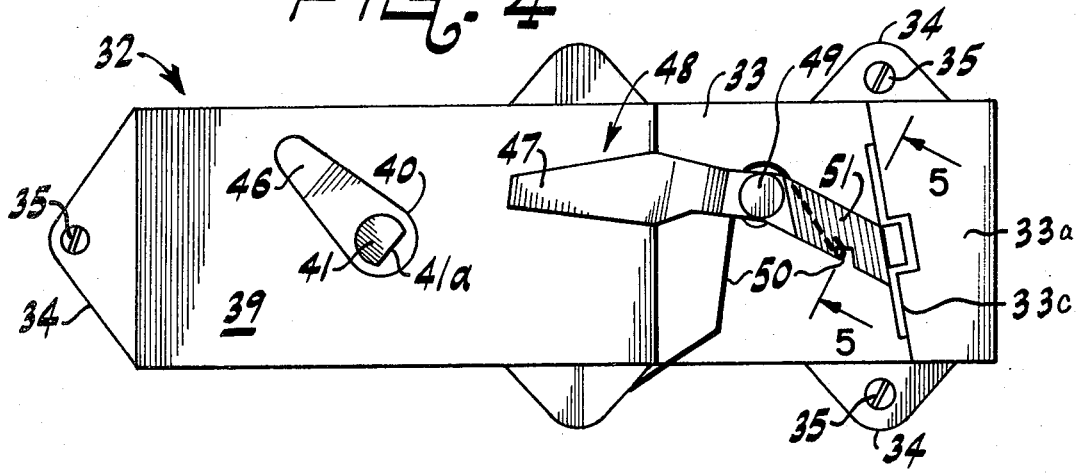
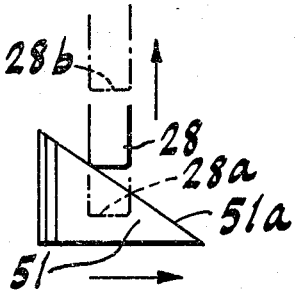
FIG. 5
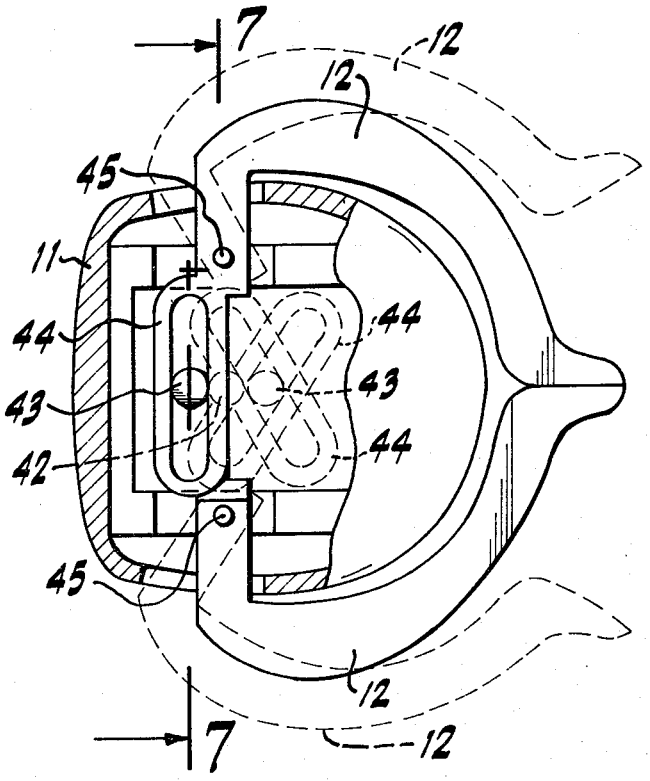
FIG. 6
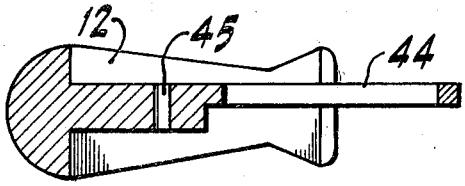
FIG. 7

AUDIO-VISUAL AMUSEMENT DEVICE

This invention relates to an audio-visual amusement device, intended particularly for children as young as three years of age, and having the potential for encouraging speech development, stimulating dexterity, and providing experience in cause and effect relationships.

It is known that the field of toys and amusement devices for young children is highly developed and that the present amusement device incorporates a number of details which are old and well known in this field. It is believed, however, that the present audio-visual amusement device provides a unique combination and control of electrically activated means for accomplishing the educational and development objective above mentioned, and does so in a safe and durable way while holding manufacturing costs to a minimum.

Regarded in certain of its broader aspects, the audio-visual device in accordance with the present invention is a device wherein one or more movable animated figures are associated with a housing structure containing an audio-amplifier, and from which extends an elongated cable terminating in a microphone and dual control head, one control establishing electrical circuit between the microphone and amplifier, and the other control activating an electrical drive mechanism which imparts motion to the animated figures. In a disclosed adaptation the motion of a first figure simulates hand clapping, while the motion of a second figure, if present, simulates excited jumping, part of the drive mechanism includes sound generating means synchronized with, and providing audio accompaniment for the hand clapping, and said part of the drive mechanism includes means for imparting motion to the second animated figure, if present.

The housing structure comprises a main housing with horizontal partition to which a drive mechanism sub-assemblage and electrical circuit components can be mounted and tested before a top closure sub-assemblage carrying the animated figures, and finally a bottom closure providing battery storage, are respectively attached to complete the overall assemblage.

While the device can be adapted for use with a wide variety of animated figures, there is special advantage in employing figures with which the young user can readily associate. With this in mind, and by arrangement with the copyright owner the device is illustrated with the "Snoopy" and "Woodstock" characters from the "Peanuts" comic strip as the animated figures. The housing and support structure can be widely varied to provide an appropriate "setting" for the selected animated figures. In this instance the housing and support structure appropriately takes the form of Snoopy's doghouse.

The elongated cable which terminates in a microphone and control head is several feet long and flexible, permitting the user to move about and be at some distance from the device thereby creating an interesting voice amplification emitted from the doghouse when the user presses a first control switch and speaks close to the microphone in the control head.

As if in response to what has been said and amplified Snoopy is caused to clap his hands by pressing a second control switch on the control head. This energizes a small electric motor which, through an appropriate gear train rotates a vertically oriented driven member at about three revolutions per second. Each revolution, through a crank keyed to said driven member, and operating in overlapped loops on Snoopy's pivoted arms, causes one cycle of spreading apart and bringing together of the arms in hand clapping fashion; and the speed of about three revolutions per second enhances the effect, as this is the approximate cadence of actual hand clapping.

Meanwhile, a radial offset on the driven member contacts, once in each revolution, one end of a spring biased lever. The other end of the lever bears against a sound chamber, and so emits a sharp, clap-like sound each time it is released. By properly orienting the radial offset of the driven member with respect to the crank offset, the arm movement and sound emission are made to coincide, thereby giving a very good audio-visual impression of hand clapping. This impression is enhanced by rotating the driven member at about three revolutions per second to thereby approximate the normal cadence of actual hand clapping.

The device could be considered complete and marketed, with the single animated figure and audio-visual hand clapping effect above described, although greater interest can be generated by a device having a plurality of animated figures, the movements of which are responsive to rotation of said driven member. The relative timing of motions in additional animated figures can be determined by the appropriate positioning of one or more radial projections on said driven member.

When simultaneous movements are desired, and in the "Peanuts" theme of the illustrated adaptation "Woodstock's" jumping should coincide with "Snoopy's" clapping, movement of the second figure, "Woodstock" can readily be controlled by a coaction between the sound generating lever and the support for the second animated figure. By providing "Woodstock" with a vertically reciprocating plunger support, the lower end of which impinges on a beveled surface of the lever, a realistic jumping effect is created each time the spring biased lever is released.

The audio-visual amusement device of the present invention will be more fully understood from the following description having reference to the accompanying drawing, in which various parts of the device have been identified by suitable reference characters in each of the views, and in which:

FIG. 4 is a plan view of the drive mechanism sub-assemblage taken in the direction of the arrows 4—4 of FIG. 3.

FIG. 5 is a partial section substantially on the line 5—5 of FIG. 4.

FIG. 6 is a fragmentary view, substantially on the line 6—6 of FIG. 2 illustrating the arm structure and movement, and FIG. 7 is a sectional view substantially on the broken line 7—7 of FIG. 6.

Figure 1:
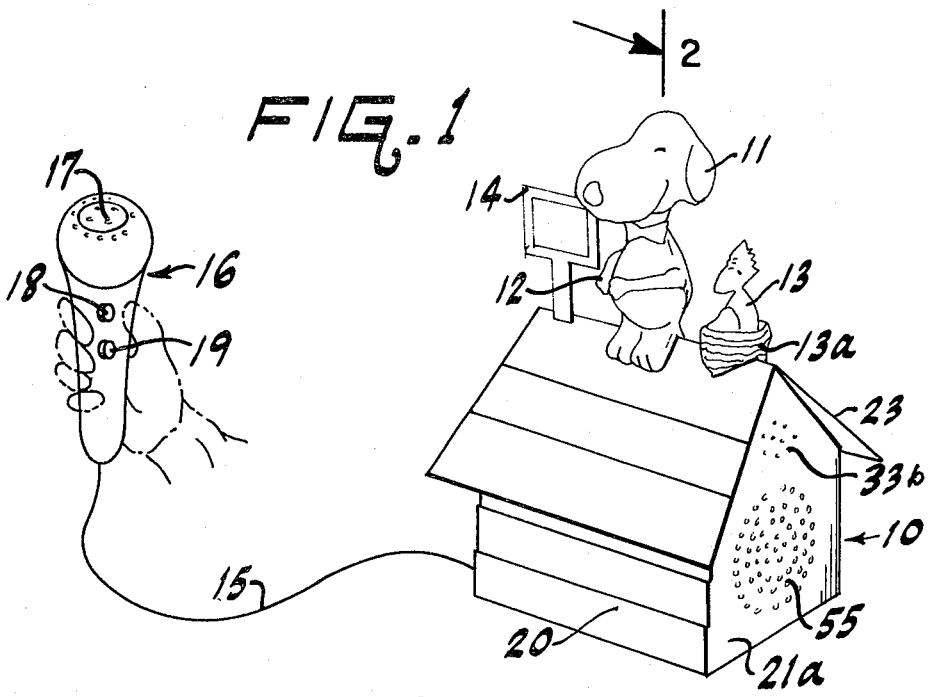
FIG. 1 is a perspective view of the audio-visual amusement device as set up for use.

As shown in the drawing a housing structure 10, here taking the form of a doghouse, supports a first animated figure 11 having movable arms 12 and a second animated figure 13, the movment of which is a jumping motion. For purpose of illustration animated figure 11 has been shown as "Snoopy" and figure 13 as "Woodstock" on his nest 13*a*, from the comic strip "Peanuts", and the figures have been shown associated with an appropriate sign 14.

Extending from the housing structure 10 is an elongated flexible electrical cable 15 terminating in a control head 16 having a microphone 17 at its end and having two depressable control switches 18 and 19.

The lower part of the housing structure 10 is of generally rectangular construction having opposed front and rear walls 20, 20*a* and opposed end walls 21, 21*a* which are joined by a horizontal partition 22. The end walls 21, 21*a* extend above the partition 22 in triangular configuration to interfit with and support a top closure member 23 of gabled structure forming, in the adaptation illustrated, the roof for the doghouse.

Figure 2:
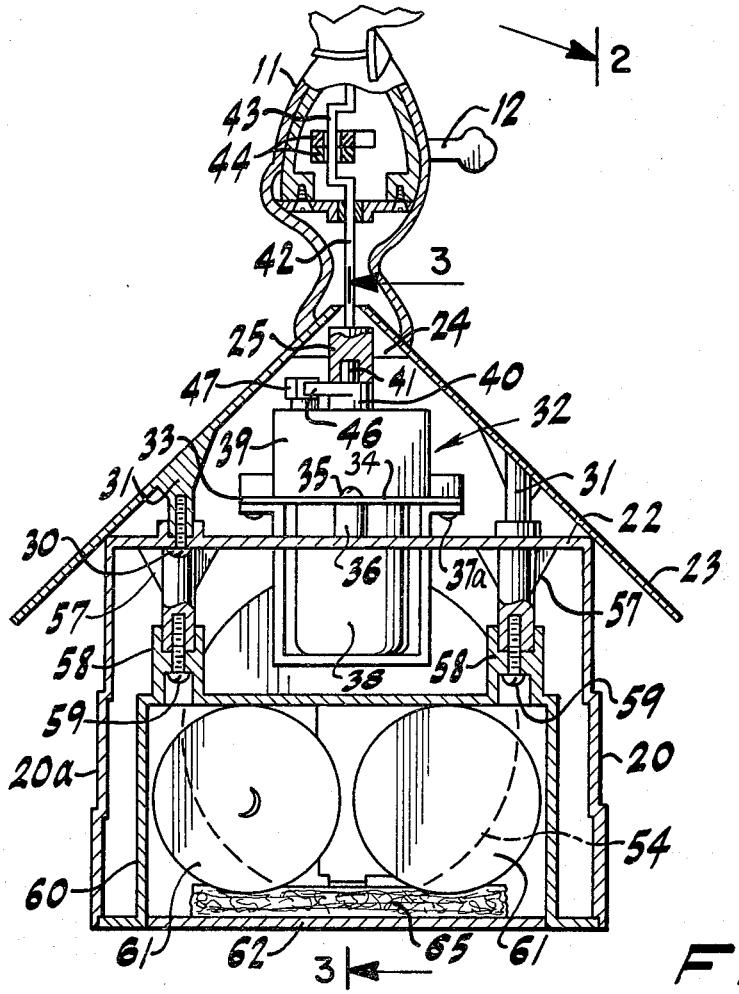
FIG. 2 is a partial, broken sectional view taken substantially on the line 2—2 of FIG. 1.
Figure 3:
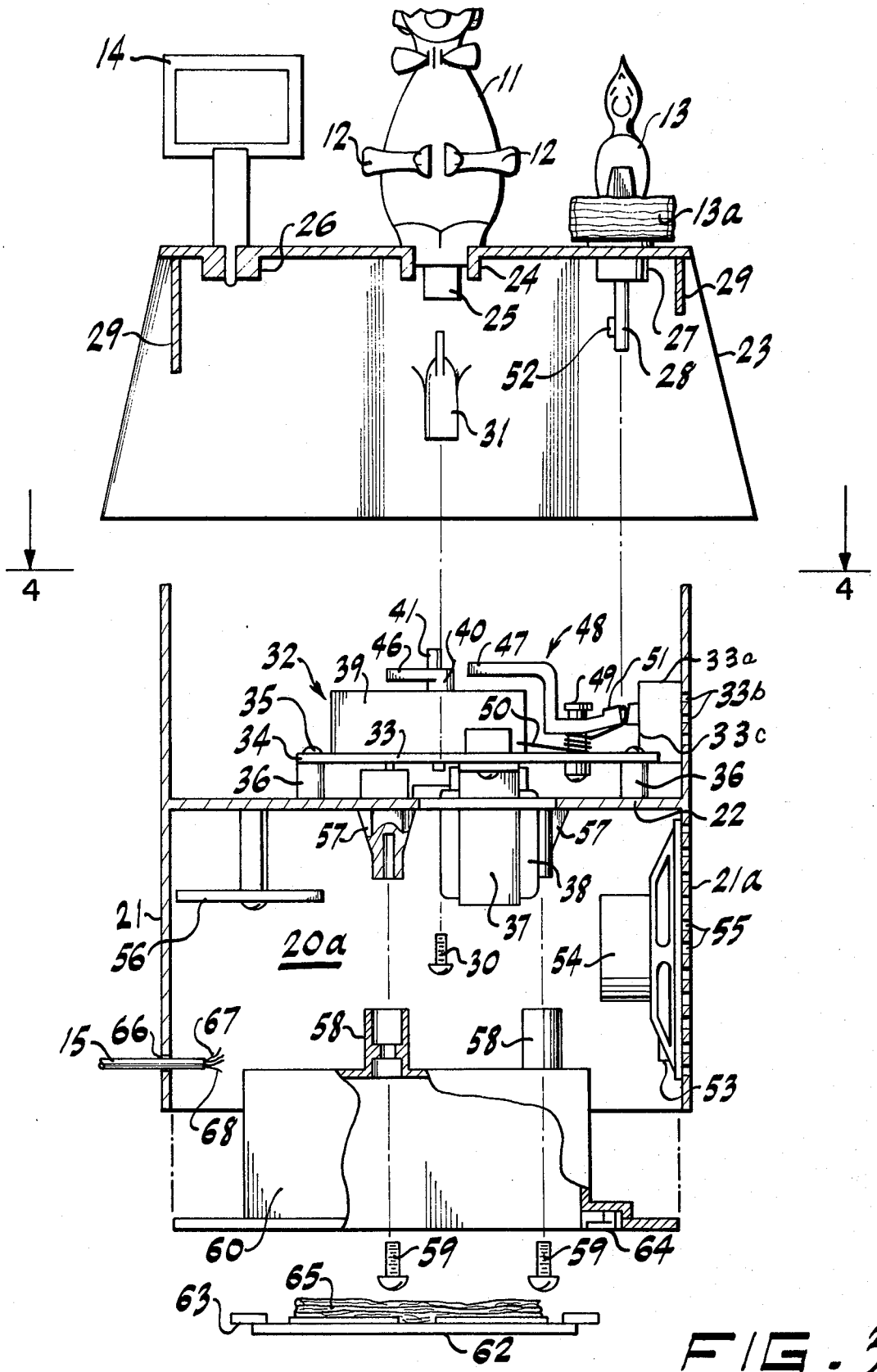
FIG. 3 is a partially expanded sectonal view taken substantially on the line 3—3 of FIG. 2.

As shown in FIGS. 2 and 3 of the drawing, the top closure 23 constitutes a sub-assemblage of the animated figures. A central socket 24 provides rigid support for the first animated figure 11 with a rotatable member 25 projecting downwardly for engagement with drive means later to be described. Spaced to one side of the socket 24 is a second socket 26 for rigidly supporting the sign 14; and at the other side of the socket 24 is a third socket 27 receiving for vertical reciprocating movement a plunger 28 which is integral with the second animated figure 13.

The closure member 23 also includes at the upper portion thereof braces 29 adapted to fit inside the end walls 21, 21*a* of the housing structure to thereby aid in aligning the closure member 23; and the closure member 23 is secured to the housing structure by suitable fasteners such as the screws 30 passing through the horizontal partition 22 into protruding socket means 31 within the closure member 23.

Mounted on the horizontal partition 22 is a drive mechanism sub-assemblage 32 comprising a base frame 33 having a plurality of projections 34 to receive screws or other fasteners 35 for detachable mounting the sub-assemblage to lugs 36 protruding upwardly from partition 22.

Detachably supported beneath the base frame 33 by means of a U strap 37 and screws or other fasteners 37*a* is an electric motor 38 having vertically oriented shaft, not shown, which extends into a gear housing 39 on the upper surface of the frame 33. A gear train within the housing 39 connects the shaft of motor 38 to a rotatably driven member 40 in such manner that the member 40 will rotate at a speed of about three revolutions per second. The driven member 40 has an upward extension 41 which is flattened at one side as seen at 41*a* to interfit with a similar contour within the projection 25 on the first animated figure 11.

Having particular reference to FIGS. 2, 6 and 7 of the drawing, it will be noted that within animated figure 11 and integral with the extension 25 is a rotatable crank member 42, the offset or crank portion 43 of which passes through aligned overlapping loops 44 of the arms 12 which are swingably movable on spaced vertical pivot axes 45.

As seen by comparing the full and dotted lines showing in FIG. 6 of the drawing, as the crank 42 rotates through 180° moving the offset 43 from the full to dotted position, the arms 12 are swung from a juxtaposed position to the spread position shown in dotted lines, with rotation of the crank 42 through another 180° returning the arms 12 to the juxtaposed position. When the crank 42 is rotated at about three revolutions per second, the movement of the arms 12 closely simulates the cadence of hand clapping.

To provide an audio complement to the simulated hand clapping the driven member 40, as clearly shown in FIG. 4, is provided with a radial offset 46 which, in each revolution of the member 40 engages and moves end 47 of lever 48 which is pivotally mounted as seen at 49 to the base plate 33 and is spring biased by coil spring 50. The other end 51 of lever 50 is contoured to bear against a sound box 33*a* which aligns with apertures 33*b* in the upward extension of end wall 21*a*. A plate 33*c* is suitably provided on the sound box 33*a* to enhance the sound generated when it is sharply struck by the spring biased lever 48 in each activation of the lever 48 by the projection 46 on the driven member 40.

It will be noted that synchronizing of the sound emission with movement of the arms 12 into juxtaposed position is governed by the angular orientation of the flattened portion 41*a* and the radial projection 46 of the driven member 40.

The lever 48 also provides means for activating a second animated figure 13, if present. As shown in FIGS. 2 and 5 the plunger 28 on figure 13 is aligned with lever end 51 in its rest position. By tapering the lever end as seen at 51*a* and providing appropriate length in the plunger 28, the plunger 28, in the rest position of lever end 51, will be supported in the slightly elevated position shown in full lines in FIG. 5. When lever 48 is activated by projection 46 of the driven member 40 the plunger 28 will drop slightly to the 28*a* position. Then as the lever 48 is released and returned suddenly to its rest position, the beveled surface 51*a* strikes the depressed plunger 28*a* propelling it to an elevated position 28*b*, from which it returns by gravity to the full line position 28. Note that means is provided on plunger 28, as indicated by the projection 52, to limit its upward movement. Thus, animated figure 13 is imparted a sudden jumping motion which is synchronized with the hand clapping of figure 11.

Within the enclosure defined by front and rear walls 20, 20*a*, end walls 21, 21*a* and partition 22, guide means 53 are provided on end wall 21*a* to slidably mount an audio speaker 54 in alignment with aperture 55 in said end wall for full emission of sound. Adjacent to the other end wall 20 is mounted an electric circuit panel 56; and protruding downwardly from partition 22 are three lugs 57 which align with socket 58, and receive screws 59 in attaching a battery casing 60 which forms the bottom of the enclosure. The battery casing suitably houses two dry cells 61 accessible by removable plate 62 supported at one end by slide hooks 63 and at the other end by a suitable fastener 64. If desired a padding 65 can be provided to more firmly support batteries 61.

The electric cable 15 which enters the enclosure through an aperture 66 in end wall 21 has been diagramatically illustrated in FIG. 3, and details of electric wiring have been omitted from FIGS. 2 and 3 for the sake of clarity. There is nothing novel in the wiring per se, and it is sufficient to note that two wires 67 of cable 15 which are in circuit with control switch 18 relate to and activate the audio speaker 54, while two other wires 68 which are in circuit with control switch 19 relate to and activate the motor 38 and the associated movable parts of the drive mechanism sub-assemblage 32.

It will be apparent from the foregoing description that the housing defined by front and rear walls 20, 20*a*, end walls 21, 21*a* and partition 22 provides for the mounting and testing of all electrical and mechanical drive components before there is need for attaching either top closure 23 or bottom closure 60. When the top closure has been secured in place by screws 30 and the bottom closure attached by means of screws 59, the assemblage is essentially tamper proof while at the same time being readily disassembled by one with appropriate tools. Thus the device is durable and practical for use by small children for whom it is primarily intended.

Various changes and modifications in the audiovisual amusement device herein disclosed may occur to those skilled in the art, and to the extent that such changes and modifications are embraced by the appended claims it is to be understood that they constitute part of the present invention.

What is claimed is:

1. An audio-visual amusement device comprising a housing supporting at least one movable animated figure, a mechanical drive mechanism including an electric motor, an audio amplifier, a battery source of electric power, and an elongated control cable, said control cable terminating in a control head including a microphone, a first control switch placing said microphone in circuit with said amplifier, and a second control switch activating the electric motor of said drive mechanism, said drive mechanism including a vertically oriented driven member, said driven member having axial means for activating a first animated figure in each revolution thereof and radial means for activating a second animated figure.

2. An audio-visual amusement device as defined in claim 1, wherein said second animated figure is mounted on a vertically movable plunger, the lower end of said plunger registering with one, beveled end of a spring biased lever having a vertical pivot axis, the other end of said lever being aligned with the radial means on said driven member, whereby said lever is moved against the spring bias thereof and released once in each revolution of said driven member.

3. An audio-visual amusement device as defined in claim 1, wherein said first animated figure has arms pivotally mounted for movement in a horizontal plane, said movement being controlled by overlapping loops integral with said arms and responsive to rotary movement of a crank extending vertically therethrough and axially coupled with the axial means of said driven member in one predetermined position of relative rotary movement.

4. An audio-visual amusement device as defined in claim 3, wherein said second animated figure is mounted on a vertically movable plunger, the lower end of said plunger registering with one beveled end of a spring biased lever having a vertical pivot axis, the other end of said lever being aligned with the radial means on said driven member, whereby said lever is moved against the spring bias thereof, and released, once in each revolution of said driven member, said beveled end of the lever bearing against a sound chamber, and said one position of rotary movement of said crank being so aligned with the radial means on said driven member that release of the spring biased lever coincides with the closest juxtaposed positioning of said pivotally movable arms, whereby the observer is aware, simultaneously, of the visual and audible impression of clapping hands by the first animated figure, and of the jumping of the second animated figure.

5. An audio-visual amusement device as defined in claim 4, wherein said driven member is rotated at approximately three revolutions per second, thereby enhancing the impression of hand clapping by simulating the cadence of actual hand clapping.

6. An audio-visual amusement device wherein at least one movable animated figure is associated with an enclosure having sound emitting means and a control extension for selectively activating figure movements and sound emissions, said device comprising a main housing having four walls in generally rectangular configuration and joined to an elevated horizontal partition, at least two opposed walls extending above said partition for engagement with a top closure, an electrical drive mechanism sub-assemblage detachably secured to the upper surface of said partition, said sub-assemblage including a motor which extends through an aperture in said partition with its shaft vertically oriented and driving a gear chain providing rotation of about three revolutions per second in a vertically oriented driven member, said driven member having an axial extension for operative engagement with one animated figure and a radial projection, said radial projection registering with one end of a spring biased lever, said lever being on a vertically disposed pivot axis with its other end bearing against a sound chamber, whereby each revolution of said driven member causes said lever to generate a sharp, clap-like sound, said top closure having at least one animated figure mounted thereon, said figure having arms pivoted for movement in a horizontal plane and having overlapped loop portion engaged by a vertically disposed crank to swing the arms apart and together in simulated clapping movement in each revolution of said crank, and a slidable engagement between the shaft of said crank and said axial extension of the driven member being oriented to synchronize the release of said lever with the coming together of said pivoted arms, whereby the visual impression of clapping movement is accompanied by a simultaneous clapping sound.

7. An audio-visual amusement device as defined in claim 6, wherein the interior of said housing below said partition includes means supporting an audio amplifier, electrical connection to said amplifier and motor and to said control extension, said control extension comprising a flexible cable passing through a wall of said housing and terminating in a control head, said control head including a microphone, a first control switch placing said microphone in circuit with the amplifier, and a second control switch activating said motor.

8. An audio-visual amusement device as defined in claim 6, wherein said top closure is assembled to the main housing by fasteners extending upwardly through said partition, and bottom closure including a battery chamber is mounted by fasteners embedded in said battery chamber and extending to said partition, whereby the assemblage is essentially tamper-proof, while being readily disassembled, as needed, using readily available tools.

9. An audio-visual amusement device wherein movable animated figures are associated with an enclosure having sound emitting means and a control extension for selectively activating figure movements and sound emissions, said device comprising a main housing having four walls in generally rectangular configuration and joined to an elevated horizontal partition, at least two opposed walls extending above said partition for engagement with a top closure, an electrical drive mechanism sub-assemblage detachably secured to the upper surface of said partition, said sub-assemblage including a motor which extends through an aperture in said partition with its shaft vertically oriented and driving a gear chain providing rotation of about three revolutions per second in a vertically oriented driven member, said driven member having an axial extension for operative engagement with a first animated figure and a radial projection, said radial projection registering with one end of a spring biased lever, said lever being on a vertically disposed pivot axis with its other end bearing against a sound chamber, whereby each revolution of said driven member causes said lever to generate a sharp, clap-like sound, said top closure having two animated figures mounted thereon, said first figure having arms pivoted for movement in a horizontal plane and having overlapped loop portion engaged by a vertically disposed crank to swing the arms apart and together in simulated clapping movement in each revolution of said crank, the second animated figure being mounted on a vertically movable plunger extending through said top closure and having a lower end registering with a beveled surface on said other end of the spring biased lever, and a slidable engagement between the shaft of said crank and said axial extension of the driven member being oriented to synchronize the release of said lever with the coming together of said pivoted arms, whereby the visual impression of clapping movement is accompanied by a simultaneous clappng sound.

* * * * *